United States Patent [19]

Dalton

[11] Patent Number: 4,491,985

[45] Date of Patent: Jan. 8, 1985

[54] HEAD COVERING FOR WOMEN WITH HAIR LOSS

[76] Inventor: Betty J. Dalton, 647 N. 16th St., Springfield, Oreg. 97477

[21] Appl. No.: 427,592

[22] Filed: Sep. 29, 1982

[51] Int. Cl.[3] ..... A42B 1/04

[52] U.S. Cl. ..... 2/171; 2/174; 2/175; 2/198

[58] Field of Search ..... 2/171, 208, DIG. 7, 2/198, 175, 202, 204, 174

[56] References Cited

U.S. PATENT DOCUMENTS

| | | | |
|---|---|---|---|
| 811,178 | 1/1906 | Saks | 2/175 |
| 2,396,503 | 9/1944 | Green | 2/198 |
| 2,996,724 | 5/1959 | Rose et al. | 2/171 |
| 3,197,787 | 8/1965 | Tognan et al. | 2/171 |
| 3,206,761 | 9/1965 | Melnikoff | 2/198 |
| 3,295,536 | 1/1967 | Shaw et al. | 2/198 |
| 3,587,114 | 6/1971 | McCourtie | 2/198 |
| 3,618,140 | 5/1970 | Goldfarb | 2/207 |
| 3,910,292 | 10/1975 | Izzo | 132/53 |
| 4,150,678 | 3/1979 | Photopulus | 132/53 |

*Primary Examiner*—Henry S. Jaudon
*Assistant Examiner*—Mary A. Ellis
*Attorney, Agent, or Firm*—James D. Givnan, Jr.

[57] ABSTRACT

A head covering having the general appearance of a turban and made from elastic fabric so as to fit securely in a snug manner about the head. Liner components are of a fleecy material to partially fill the interior of the head covering and thereby compensate for the wearer's loss of hair to render the appearance of a head covering worn over a full head of hair.

3 Claims, 4 Drawing Figures

HEAD COVERING FOR WOMEN WITH HAIR LOSS

BACKGROUND OF THE INVENTION

The present invention pertains generally to an item of headgear for women and particularly to such an item for wear by those women experiencing a hair loss.

In chemotherapy a common side effect is the total loss of hair to the extent the person must resort to the wearing of a wig or hairpiece both of which require considerable care and attention when worn. Accordingly, wigs and the like have not been usable in the past for the reason that the headgear, when in place on the head, has an unusual appearance in view of the hair loss. A common implication of such hair loss is that the person undergoing chemotherapy undesirably tends to avoid encounters with the public.

In a copending application filed by the present inventor, Ser. No. 397,108 filed July 12, 1982, a head covering in the form of a scarf with a fabric filler is disclosed for use by those persons having a hair loss.

SUMMARY OF THE PRESENT INVENTION

The present invention is embodied in a piece of headgear which when worn obscures a partial or total loss of hair from view.

The present headgear is of elastic fabric for secure retention on the head. The general appearance is in the nature of a turban but having concealed fabric pieces which provide an attractive normal appearance by compensating for the absence of hair, i.e., holding the headgear away from the wearer's scalp. Use of an elastic fabric assures that the scalp is entirely concealed from view and that the headgear is not susceptible to accidental dislodgment.

Important objectives include the provision of headwear that is both comfortable and highly attractive and may be readily donned without tedious preparation as is the case with wigs and hairpieces; the provision of a piece of headgear which is of elastic construction to fit snugly about the head; the provision of a piece of headgear that is comfortable while the wearer is bedridden.

BRIF DESCRIPTION OF THE DRAWINGS

DETAILED DESCRIPTION OF THE PREFERRED EMBODIMENT

Figure 1:
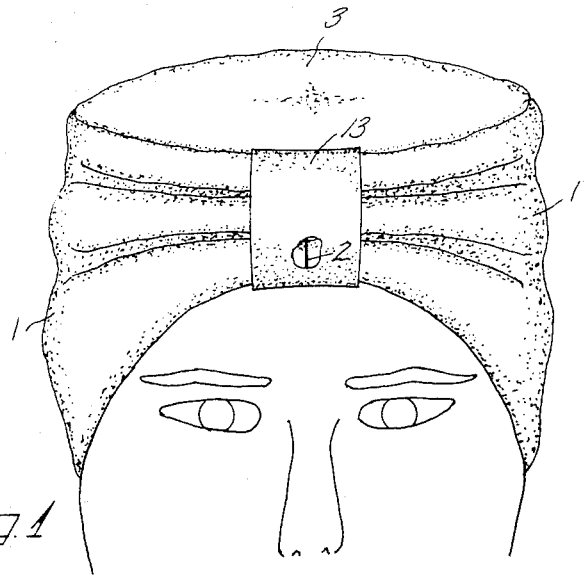
FIG. 1 is a front elevational view of the present head covering.
Figure 2:
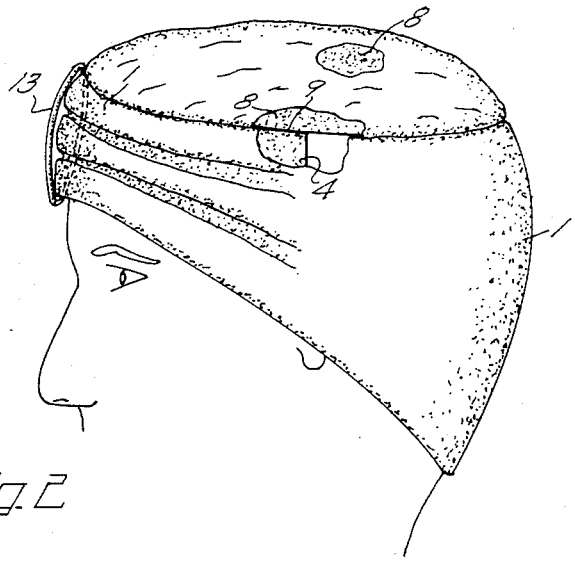
FIG. 2 is a side elevational view taken from the right side of FIG. 1.

In the following description, applied reference numerals indicate parts similarly identified in the drawing and wherein reference numeral 1 indicates a continuous main body of the head covering formed from a single piece of fabric cut in a trapezoidal shape with the nonparallel side edges joined with a concealed frontal seam at 2.

A circular top piece 3 is stitched about its periphery to the continuous main body with the joined edges being concealed from view.

Figure 3:
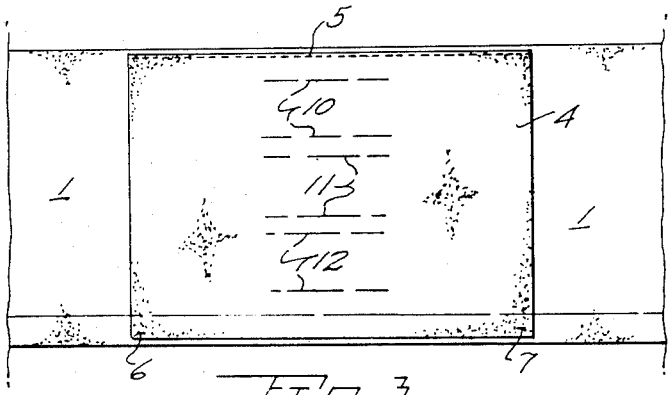
FIG. 3 is a fragmentary elevational view of a main body piece of the head covering with an attached liner in place.
Figure 4:
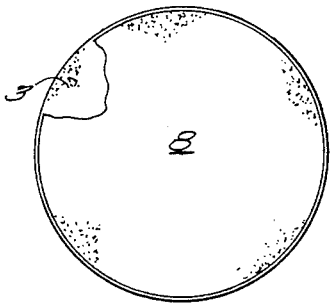
FIG. 4 is a bottom plan view of a top piece of the head covering with an attached liner in place.

A first fabric liner at 4 in FIG. 3 extends approximately about the frontal half of the main body and is stitched along top stitching at 5 and tacked 6 and 7 to the lower sides of the main body.

A top or second fabric liner at 8 is of circular shape and coextensive with top outer member 3 of the headpiece and sewn in place by a concealed top seam 9 attaching same to outer member 3.

Both liners 4 and 8 are of fleecy nature.

The frontal portion of the main body 1 is sewn into folds by folding the paired lines at 10—10, 11—11 and 12—12 together and stitching same.

A vertical band 13 which extends downwardly from top stitching 9 is turned inwardly and upwardly for termination in stitched attachment to its upper end which passes through an opening in seam 9. The band is of tubular construction.

The liner members 4 and 8 contribute significantly to the simulation of a turban shaped head covering worn over a full head of hair. The elastic nature of the main body causes same to fit snugly about the wearer's forehead, temples, sides and lower back of the head to totally conceal the scalp and engages liner 4 into contact with the wearer's forehead.

The main body 1 and top piece 3 of the head covering are prefereably made from knitted fabric having elastic characteristics. Two such suitable fabrics may be woven from fibers such as those sold under the registered trademark of Lycra or Spandex commonly used in swimsuit manufacture and having elastic properties along perpendicular axes.

Main body member 1 is of trapezoidal shape having its upper side and lower sides approximately eighteen and twenty-one inches in length when the head covering made for an adult. The top piece 3 is approximately seven and one-half inches in diameter.

When in place on the head the front and top liners impart an appearance to the covering to create the effect of overlying a full head of hair. The main body 1 is readily stretchable to permit donning of the head covering and subsequent concealment of the wearer's hairless scalp.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A head covering for the hairless scalp of women experiencing a total hair loss from chemotherapy, said covering comprising, a continuous main body member of elastic material for stretched engagement about the wearer's head, said main body member adapted to overlie the back of the wearer's head, a top piece of circular shape stitched at its edge to said continuous member, a first fabric liner of a fleecy nature arranged at a frontal portion of said main body and extending at least partially about the interior thereof so as to be pressed into engagement with the wearer's forehead by said main body member, a second fabric liner of a fleecy nature affixed to the underside of said top piece, and the main body member and said top piece being at least partially supported by said first and second fabric liners when the head covering is worn to render the appearance of a head covering worn over a full head of hair.

2. The head covering claimed in claim 1 wherein said top piece is also of an elastic nature.

3. The head covering claimed in claim 1 wherein said first fabric liner extends interiorly about only the frontal portion of the main body member, said main body member being of an elastic material capable of comparing the first fabric liner against the wearer's forehead to prevent accidental shifting of the head covering while being worn.

* * * * *